US009169528B2

(12) United States Patent
Vanoverberghe et al.

(10) Patent No.: US 9,169,528 B2
(45) Date of Patent: Oct. 27, 2015

(54) STEEL FILAMENT PATENTED IN BISMUTH

(75) Inventors: Koen Vanoverberghe, Dilbeek (BE); Willem Dekeyser, Assebroek (BE); Dirk Meersschaut, Ooigem (BE)

(73) Assignee: NV Bekaert SA, Zwevegem (BE)

( * ) Notice: Subject to any disclaimer, the term of this patent is extended or adjusted under 35 U.S.C. 154(b) by 140 days.

(21) Appl. No.: 12/936,654

(22) PCT Filed: Feb. 13, 2009

(86) PCT No.: PCT/EP2009/051679

§ 371 (c)(1),
(2), (4) Date: Oct. 6, 2010

(87) PCT Pub. No.: WO2009/132868

PCT Pub. Date: Nov. 5, 2009

(65) Prior Publication Data

US 2011/0114231 A1 May 19, 2011

(30) Foreign Application Priority Data

Apr. 30, 2008 (EP) ..... 08155484

(51) Int. Cl.

| | |
|---|---|
| ***C21D 8/02*** | (2006.01) |
| ***C21D 9/52*** | (2006.01) |
| ***C21D 9/00*** | (2006.01) |
| ***C21D 11/00*** | (2006.01) |
| ***C21D 8/06*** | (2006.01) |
| ***C21D 9/573*** | (2006.01) |

(52) U.S. Cl.

CPC *C21D 8/065* (2013.01); *C21D 9/52* (2013.01); *C21D 9/525* (2013.01); *C21D 9/573* (2013.01); *C21D 9/5732* (2013.01)

(58) Field of Classification Search

None

See application file for complete search history.

(56) References Cited

U.S. PATENT DOCUMENTS

| | | | | |
|---|---|---|---|---|
| 3,858,423 | A | 1/1975 | Sendzimir | |
| 4,767,472 | A | 8/1988 | Vanneste | |
| 4,813,652 | A | 3/1989 | Piepers | |
| 4,944,174 | A | 7/1990 | Muller | |
| 7,972,452 | B2 | 7/2011 | Kaiser et al. | |
| 2002/0179207 | A1 * | 12/2002 | Koike et al. | 148/648 |
| 2008/0006350 | A1 * | 1/2008 | Junius et al. | 148/559 |
| 2011/0198786 | A1 * | 8/2011 | Kaiser et al. | 266/133 |

FOREIGN PATENT DOCUMENTS

| | | | | |
|---|---|---|---|---|
| CN | 2014 47495 | | 5/2010 | |
| DE | 10 2004 048443 | | 12/2005 | |
| DE | 10 2004 048443 | B3 | 12/2005 | |
| DE | WO 2006/050680 | * | 5/2006 | C21D 9/52 |

(Continued)

OTHER PUBLICATIONS

ASM, Steels: Processing, Structure, and Performance 281-295 (2005).*

(Continued)

*Primary Examiner* — Yoshitoshi Takeuchi

(74) *Attorney, Agent, or Firm* — Shlesinger, Arkwright & Garvey LLP

(57) ABSTRACT

A cold drawn carbon steel filament has a surface with traces of bismuth. The steel filament can be used as a sawing wire or as part of a steel cord. During its manufacturing the steel filament has been subjected to a controlled cooling by bringing the steel filament in contact with bismuth. Bismuth may replace lead without harming the environment.

7 Claims, 1 Drawing Sheet

(56) References Cited

FOREIGN PATENT DOCUMENTS

| | | | | |
|---|---|---|---|---|
| DE | WO 2007/054063 | * | 5/2007 | ..... C21D 1/20 |
| EP | 0 181 653 | | 5/1986 | |
| EP | 0 216 434 | | 4/1987 | |
| EP | 0 410 501 | | 1/1991 | |
| EP | 0 524 689 | | 1/1993 | |
| FR | 1 349 720 | A | 1/1964 | |
| FR | 1349720 | | 1/1964 | |
| GB | 1 011 972 | A | 12/1965 | |
| GB | 1011972 | * | 12/1965 | |
| JP | 55 110717 | | 8/1980 | |
| JP | H 05 287480 | | 11/1993 | |
| JP | H 06 346152 | | 12/1994 | |
| JP | 2002 241899 | | 8/2002 | |
| JP | 2004 011002 | | 1/2004 | |

OTHER PUBLICATIONS

Tashiro et al, State of the Art for High Tensile Strength Steel Cord, Nippon Steel Tech Rpt (2003).*

Dove, Steel Wire, Properties and Selection: Irons, Steels, and High Performance Alloys, 277-288 ASM Handbook 1 (1990).*

AvestaPolarit, High Temprature Stainless Steels within the Steel and Metals Industry (2007).*

International Search Report of PCT/EP2009/051679 dated May 14, 2009 (3 pgs.).

* cited by examiner

STEEL FILAMENT PATENTED IN BISMUTH

TECHNICAL FIELD

According to one aspect, the invention relates to a cold drawn carbon steel filament.

According to a second aspect, the invention related to a method of controlled cooling a high-carbon steel filament.

According to a third aspect, the invention relates to an installation for continuous controlled cooling of a high-carbon steel filament.

BACKGROUND ART

High-carbon cold drawn steel filaments are known in the art. Cold drawing is applied to obtain the final diameter and to increase the tensile strength of the steel filament. The degree of drawing is, however, limited. The higher the degree of drawing, the more brittle the steel filament and the more difficult to reduce further the diameter of the steel filament without causing too much filament fractures. Commercially available wire rod diameters are typically 5.50 mm or 6.50 mm. Direct drawing from wire rod until very fine diameters is not possible.

The above-mentioned limited degree of drawing is the reason why the various drawing steps are alternated with one or more intermediate heat treatments. These heat treatments "reorganize" the internal metal structure of the steel filaments so that further deformation is possible without increase in the frequency of filament fractures. The heat treatment is mostly a patenting treatment, i.e. heating until above the austenitizing temperature followed by cooling the steel filament down to between 500° C. and 680° C. thereby allowing transformation from austenite to pearlite.

The prior art has provided several ways for carrying out the cooling phase and the transformation from autenite to pearlite.

The cooling phase or transformation phase may be carried out in a bath of lead or a lead alloy, such as disclosed in GB-B-1011972 (filing date 14 Nov. 1961). From a metallurgical point of view, this is the best way for obtaining a proper metal structure for enabling further drawing of the steel wire. The reason is that having regard to the good heat transfer between the molten lead and the steel wire, the transformation from austenite to pearlite is more or less isothermal. This gives a small size of the grains of the thus transformed steel wire, a very homogeneous metallographic structure and a low spread on the intermediate tensile strength of the patented wire. A lead bath, however, may cause considerable environmental problems. More and more, legislation is such that lead is forbidden because of its negative impact on the environment. In addition, lead may be dragged out with the steel wire causing quality problems in the downstream processing steps of the steel wire. Hence, since a number of years, there has been an increasing need to avoid lead in the processing of steel wires and to have alternative transformation or cooling methods.

EP-A-0 181 653 (priority date 19 Oct. 1984) and EP-B1-0 410 501 disclose the use of a fluidized bed for the transformation from austenite to pearlite. A gas which may be a combination of air and combustion gas fluidizes a bed of particles. These particles take care of the cooling down of the steel wires. A fluidized bed technology may give the patented steel wire a proper metal structure with fine grain sizes and a relatively homogeneous metallographic structure. In addition, a fluidized bed avoids the use of lead. A fluidized bed, however, requires high investment costs for the installation and high operating or maintenance costs.

The austenite to pearlite transformation may also be done in a water bath such as disclosed in EP-A-0 216 434 (priority date 27 Sep. 1985). In contrast with fluidized bed technology, water patenting has the advantage of low investment costs and low running costs. Water patenting, however, may give problems for wire diameters smaller than 2.8 mm. The reason is that the heat content of a steel wire is proportional to its volume and the volume of a steel wire is proportional to $d^2$, where d is the diameter of the steel wire:

$$\text{heat content}=C_1\times d^2$$

The surface of a wire is proportional to its diameter d:

$$\text{surface}=C_2\times d$$

As a result, the cooling speed which is proportional to the surface and inversely proportional to the heat content, is inversely proportional to the diameter d:

$$\text{cooling velocity}=(C_2\times d)/(C_1\times d^2)=C_3/d$$

The consequence is that fine steel wires are cooled too fast, which increases the risks for formation of bainite or martensite.

EP-0 524 689 (priority date 22 Jul. 1991) discloses a solution to the above-mentioned problem with water patenting. The cooling is done by two or more water cooling periods alternated with one or more air cooling periods. The cooling speed in air is not that high as in water. By alternating water cooling with air cooling the formation of bainite or martensite is avoided for steel wires with a diameter greater than about 1.10 mm. As with water patenting, this water/air/water patenting is cheap in investment and cheap in maintenance costs. However, a water/air/water patenting method also has its inherent limitations. A first limitation is that for very fine wire diameters, the smallest water bath may also cause risk for bainite or martensite formation. A second limitation is that the water/air/water patenting result in a metal structure which is too soft, i.e. with grain sizes which are greater than the grain sizes obtainable with lead patenting or with fluidized bed patenting. This soft structure is featured by a reduced tensile strength. In addition, the metallographic structure is not so homogeneous and the spread on the intermediate tensile strength of the patented wire may be high.

Cancelling all water baths and using only air patenting is an option with the advantage that the risk for formation of bainite or martensite is not existent or very limited. However, air patenting leads to even softer and more inhomogeneous metal structures than water patenting or water/air/water patenting.

The above prior art illustrates that there is a need for an environment friendly way of continuous and controlled cooling of steel wire which gives intermediate steel wires with a high intermediate level of tensile strength of the patented wire, a small grain size and a homogeneous metallographic structure.

DISCLOSURE OF INVENTION

It is a general object of the present invention to avoid the drawbacks of the prior art.

It is a first object of the present invention to provide a patenting method and installation which is not harmful for the environment.

It is a second object of the present invention to provide a patenting method and installation which gives a metal structure to the steel wire comparable to the metal structure obtained by lead patenting or fluidized bed patenting.

It is a third object of the present invention to avoid quality problems in the downstream processing of the steel wire after patenting.

It is a fourth object of the present invention to provide a method of controlled and continuous cooling of a steel wire, independent of the steel wire diameter.

According to a first aspect of the present invention, there is provided a cold drawn carbon steel filament having on its surface traces of bismuth.

The terms "carbon steel filament" refer to a steel filament with a plain carbon steel composition where the carbon content ranges between 0.10% and 1.20%, preferably between 0.45% and 1.10%. The steel composition may also comprise between 0.30% and 1.50% manganese and between 0.10% and 0.60% silicon. The amounts of sulphur and phosphorous are both limited to 0.05% each. The steel composition may also comprise other elements such as chromium, nickel, vanadium, boron, aluminium, copper, molybdenum, titanium. The remainder of the steel composition is iron. The above-mentioned percentages are all percentages by weight.

The terms "on its surface" refer to the uppermost 1-3 monolayers.

The term "traces" means that the amounts are there but are that limited that they have no function other than a remaining rest of a previous operation or process step.

The traces of bismuth are the remaining rest of a previous patenting treatment with bismuth. After the patenting treatment the steel wire has been cold drawn to a steel filament at its final diameter.

As a matter of a first example, such a cold drawn carbon steel filament can be used as a sawing wire.

As a matter of a second example, such a cold drawn carbon steel filament can be used in steel cords for reinforcement of rubber products or of polymeric products.

In both applications, as sawing wire or as steel filament in a steel cord, the steel filaments may be coated with a metal coating providing corrosion resistance or with a metal coating leading to improved adhesion with rubber or with polymers.

Bismuth is a white, crystalline, brittle metal with a low melting temperature (271.3° C.). Although being a heavy metal, bismuth is recognized as one of the safest elements from an environment and health point of view. Bismuth is non-carcinogenic. Hence, using bismuth avoids the typical environmental problems one has when using lead. Hereinafter, other advantages of the use of bismuth will be mentioned.

Using bismuth instead of lead for patenting of a steel wire result in a comparable isothermal transformation from austenite to pearlite and in properties such as a small grain size, a very homogeneous metallographic structure and a high intermediate tensile strength of the patented wire which are comparable to those obtained by means of lead patenting. The bismuth bath does not contain lead.

When taking appropriate measures, as will be explained hereinafter, the drag out of bismuth can be limited to very small amounts. As a result, there are no disadvantageous effects of bismuth on the downstream stream processing steps of the steel wire.

The bismuth patenting can be done at very fine intermediate wire diameters. Hence, very fine final filament diameters and related high final tensile strengths can be obtained after final wire drawing.

According to a second aspect of the present invention, there is provided a method of continuous controlled cooling of a high-carbon steel filament, e.g. a method of patenting a high-carbon steel filament. The method comprises the step of contacting the steel filament with bismuth during the cooling phase.

Preferably the steel wire is conducted through a bath of bismuth. This bath does not contain lead.

According to a third aspect of the present invention, there is provided an installation for continuous and controlled cooling of a high-carbon steel filament. The installation comprises a bath of bismuth. The steel filament comes into contact with the bismuth inside the bath during the cooling phase.

In a preferable embodiment of the invention, the bismuth bath has two or more zones allowing for separate temperature monitoring and/or control.

In another preferred embodiment of the invention, efforts are done to reduce the amount of bismuth in the installation. The reason is that, in comparison with lead, bismuth is relatively expensive. One of the ways to reduce the volume of bismuth is to introduce so-called dead bodies into the bath. The term dead bodies refer to bodies which have no other function than reducing the amount of bismuth.

BRIEF DESCRIPTION OF FIGURES IN THE DRAWINGS

MODE(S) FOR CARRYING OUT THE INVENTION

Figure 1:
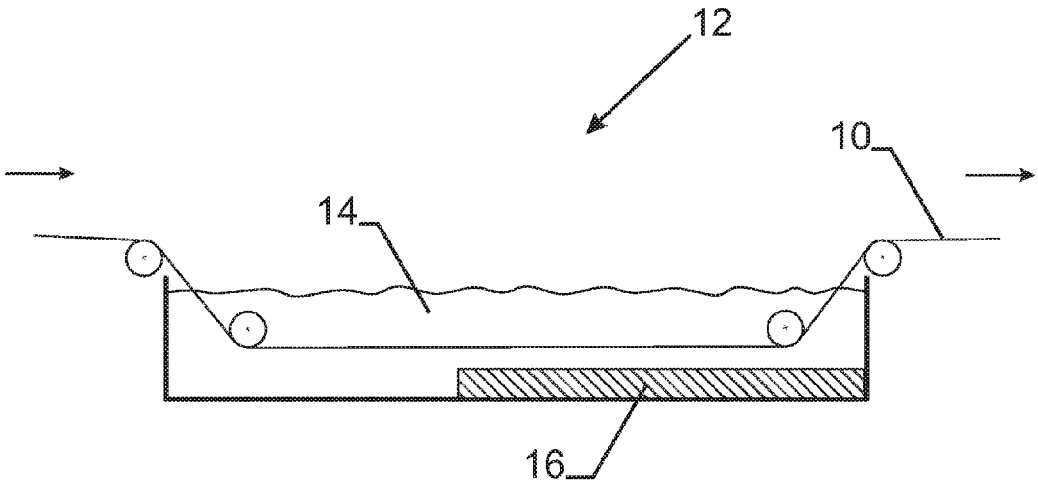
FIG. 1 shows a longitudinal section of one embodiment of a bismuth bath.

FIG. 1 illustrates the cooling step in the patenting treatment of a steel wire 10. A high-carbon steel rod has first been cold drawn to an intermediate steel wire at an intermediate steel wire diameter. This intermediate steel wire diameter may vary within a large range since the bismuth cooling is independent of the wire diameter. The intermediate steel wire diameter may go down to 0.70 mm and lower.

The intermediate steel wire 10 is first heated in a furnace (not shown) until above the austenitizing temperature, e.g. at about 900° C. for a 0.80 wt % carbon steel. Immediately after leaving the furnace the steel wire 10 is guided in a bath 12 of bismuth 14.

Existing lead baths may now be used as bismuth bath 10, just by replacing lead with bismuth in the bath. However, bismuth is more expensive than lead so that measures are preferably taken to reduce the volume of bismuth required.

The bath 12 of bismuth 14 may comprise dead bodies such as a dummy iron block 16. The function of these dead bodies is nothing else than reducing the required amount of bismuth.

Figure 2:
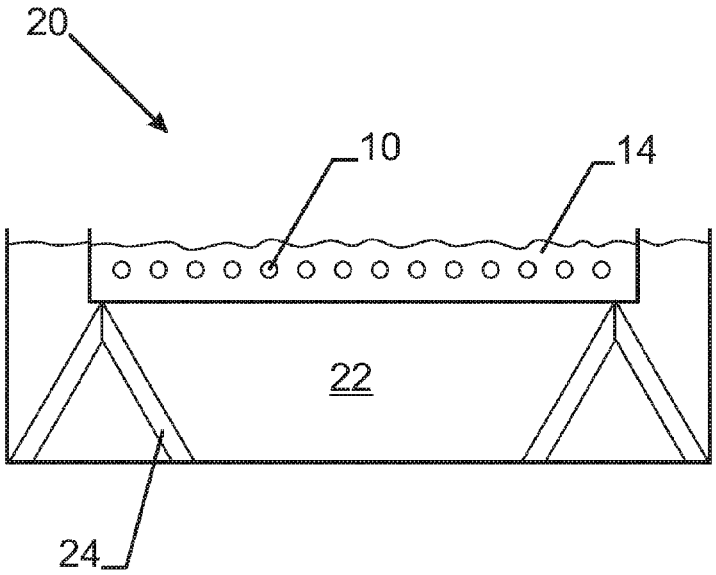
FIG. 2 shows a transversal section of another embodiment of a bismuth bath.

FIG. 2 illustrates another embodiment of an installation 20 where efforts have been made to reduce the required amount of bismuth 14. A number of parallel steel wires 10 run in a small bath of bismuth 14 which is positioned by means of supporting elements 24 "en bain marie" in a larger bath of a molten salt or of lead 22.

The length of the bismuth bath 12 can be divided into two or more zones with individual and separate monitoring and/or control of the temperature. As a matter of example only, the bath may be divided into two zones. A first zone contains mains for heating and cooling. The second zone contains means for heating only, since the steel wires 10 have already been cooled down to a large extent.

Heating of the bismuth bath may be done by means of outside burners, by means of electrical immersion coils or by induction. Local cooling of the bismuth bath may be done by means of air or gas running in tubes in and around the bath.

Metal Structure of Intermediate Steel Wire

Experiments with an intermediate 0.80 wt % carbon steel wire of 1.48 mm diameter have shown that an intermediate tensile strength $R_m$ could be obtained which is almost as high, i.e. 99%, of the intermediate tensile strength $R_m$ of a same steel wire patented in a lead bath.

Similarly the grain size of the intermediate steel wire patented in a bismuth bath is comparable to the grain size of a same steel wire patented in a lead bath.

Equally, the homogeneity of the metallographic structure of the intermediate steel wire patented in a bismuth bath is more or less equal to the homogeneity of the metallographic structure of the intermediate steel wire patented in a lead bath.

Steel wires patented in a bismuth bath have also the advantage that no or very limited decarburization, i.e. loss of carbon at the surface of the steel wire, takes place.

Bismuth Dragout

The dragout of bismuth can be avoided or at least limited to a very high degree if the bismuth bath is kept free as much as possible from oxides and if an oxide layer is present on the surface of the steel wire. The bismuth bath can be kept substantially free of oxides when covering the bismuth bath by means of anthracite. In addition to iron oxides produced during austenitizing, iron oxides may also be produced inside the bismuth bath, since the corrosion rate of steel by liquid bismuth is quite high. The iron oxides FeO, $Fe_2O_3$ and $Fe_3O_4$ do not react with the bismuth and do not give dragout. Only Fe may cause Bi dragout. This is in contrast with a lead bath, where both Fe and $Fe_2O_3$ may cause dragout of Pb.

Hence, the amount of bismuth dragout can be kept to a minimum and thus the possible poisoning of the downstream processing steps.

Amounts of Bismuth Still on the Final Steel Wire.

Despite the dragout of bismuth is very limited, traces of bismuth can still be observed on the final steel filament, i.e. even after coating the intermediate steel wire with brass or zinc and after drawing the steel wire until a final steel filament with a diameter e.g. below 0.40 mm, e.g. below 0.30 mm, e.g. below 0.20 mm.

The traces of bismuth can be detected by the technique of Time-of-Flight-Secondary-Ion-Mass-Spectrometry (ToF-SIMS). ToF-SIMS provides information on the atomic and molecular composition of the uppermost one to three monolayers with sensitivities at ppm level and lateral resolutions down to 100 nm. ToF-SIMS is not an inherently quantitative technique because the detected intensities depend on the chemical composition of the ambient material (the so-called "matrix-effect"). Semi-quantitative information can be obtained if the chemical environment of the samples to be compared is similar.

For the ToF-SIMS measurements of the present invention, an ION-TOF "TOF-SIMS IV" SIMS instrument was used. Ion bombardment of the surface was performed using $Bi_1^+$ resp. $C_{60}^+$ at 25 keV energy. Spectra were taken from an area of 20 μm×20 μm. Only positively charged secondary ions were detected. Each sample was sputter cleaned with 10 keV $C_{60}^+$ for at least ten seconds before analysis to remove organic contaminations from the surface.

TABLE 1

Results with the C60+ analysis gun

| | Ref 1 | | Ref 2 Invention | | Ref 3 | |
|---|---|---|---|---|---|---|
| | 1 | 2 | 1 | 2 | 1 | 2 |
| Bi ion | 0.06 | 0.07 | 1.54 | 1.71 | 0.06 | 0.07 |

Reference 1 relates to a 0.120 mm (120 μm) brass coated steel filament which has been patented in a water air water installation.
Reference 2, the "Invention", relates to a 0.120 mm (120 μm) brass coated steel filament which has been made according to the present invention.
Reference 3 relates to a 0.120 mm (120 μm) brass coated steel filament which has been patented in a lead bath.
The number "1" refers to first position, the number "2" refers to a second position.

TABLE 2

Results with the $Bi_1$+ analysis gun

| | Ref 1 | | Ref 2 Invention | | Ref 3 | |
|---|---|---|---|---|---|---|
| | 1 | 2 | 1 | 2 | 1 | 2 |
| Bi ion | 2.05 | 2.29 | 11.12 | 11.80 | 2.69 | 2.41 |

The samples were the same as for Table 1.
The abbreviations have the same meaning as in Table 1.

Generally, when carrying out the analysis with a $C_{60}^+$ gun, an invention sample gives amounts which are at least eight, e.g. ten times greater than amounts measured on samples which have not gone through a bismuth bath when patenting.

Also generally, when carrying out the analysis with a $Bi_1^+$ gun, an invention sample gives amounts which are at least two, e.g. three times greater than amounts measured on samples which have not gone through a bismuth bath when patenting.

Both the C60+ analysis gun and the $Bi_1$+ analysis gun give numerical values even on samples which have not gone through a bismuth bath. This has to do with the very sensitive nature of the analysis and on the very local character, e.g. areas of only 20 μm×20 μm have been investigated. The Bi ion level on reference 1 samples and reference 2 samples are to be considered as unavoidable noise.

Generally, we can state that for invention samples Bi has been detected clearly above noise level (=8 to 10 time with a $C60^+$ gun and 2 to 3 times with a $Bi_1^+$ gun) and Pb has been detected at noise level.

For wires having been patented in PbBi baths, both Bi and Pb have been detected above noise level.

The invention claimed is:

1. A cold drawn carbon steel filament, said carbon steel filament has gone through a bismuth bath when patenting, the carbon steel filament comprising:

a) a surface with traces of bismuth and without lead, when detecting the bismuth in an uppermost 1-3 monolayers of said carbon steel filament by a technique of time-of-flight-secondary-ion-mass-spectrometry, the bismuth is one of:

i) eight to ten times greater than amounts measured on one carbon steel filament which has not gone through a bismuth bath when patenting when carrying out measurement with a $C_{60}^+$ gun, and ii) two to three times greater than amounts measured on one carbon steel filament which has not gone through a bismuth bath when patenting when carrying out measurement with a $Bi_1^+$ gun.

2. The carbon steel filament according to claim 1, wherein:

a) the carbon steel filament is a sawing wire.

3. A steel cord configured for reinforcement of one of rubber products and of polymer products, the steel cord including at least one carbon steel filament according to claim 1.

4. A method of continuous controlled cooling of a high-carbon steel filament, the method comprising the steps of:

a) cold drawing a high-carbon steel rod to yield an intermediate high-carbon steel filament;

b) then heating the intermediate high-carbon steel filament from the cold drawing step until above its austenitizing temperature to yield a high-carbon steel filament;

c) contacting the high-carbon steel filament with bismuth in a bismuth bath when patenting to yield a high-carbon steel filament with traces of bismuth and without lead; and d) when detecting the bismuth in an uppermost 1-3 monolayers of said carbon steel filament by a technique of time-of-flight-secondary-ion-mass-spectrometry, the bismuth is one of:

i) eight to ten times greater than amounts measured on one carbon steel filament which has not gone through a bismuth bath when patenting when carrying out measurement with a $C_{60}^{+}$ gun, and ii) two to three times greater than amounts measured on one carbon steel filament which has not gone through a bismuth bath when patenting when carrying out measurement with a $Bi_1^{+}$ gun.

5. The method according to claim 4, wherein:

a) the contacting with bismuth is done by conducting the steel filament through the bath of bismuth.

6. The method according to claim 4, wherein:

a) the contacting is done by conducting the steel filament through the bath of bismuth, and bodies are provided in the bath in order to reduce to volume of bismuth needed in the bath.

7. The method according to claim 4, wherein:

a) the contacting is done by conducting the steel filament through the bath of bismuth, and the bath of bismuth has at least two zones allowing for separate temperature monitoring.

* * * * *